US010363490B1

(12) United States Patent
Thurmond

(10) Patent No.: US 10,363,490 B1
(45) Date of Patent: Jul. 30, 2019

(54) INTERACTIVE PAPER BIRD TOY AND FOLDING METHOD

(71) Applicant: Sarah Thurmond, Dillon, MT (US)

(72) Inventor: Sarah Thurmond, Dillon, MT (US)

( * ) Notice: Subject to any disclaimer, the term of this patent is extended or adjusted under 35 U.S.C. 154(b) by 0 days.

(21) Appl. No.: 15/793,233

(22) Filed: Oct. 25, 2017

(51) Int. Cl.

| | |
|---|---|
| ***A63H 3/08*** | (2006.01) |
| ***A63H 33/16*** | (2006.01) |
| ***A63H 3/14*** | (2006.01) |
| ***A63H 3/28*** | (2006.01) |
| ***A63H 3/16*** | (2006.01) |

(52) U.S. Cl.
CPC ..... *A63H 3/08* (2013.01); *A63H 3/14* (2013.01); *A63H 3/16* (2013.01); *A63H 3/28* (2013.01); *A63H 33/16* (2013.01)

(58) Field of Classification Search
CPC ... A63H 3/08; A63H 3/10; A63H 3/14; A63H 33/16
See application file for complete search history.

(56) References Cited

U.S. PATENT DOCUMENTS

| | | | | | |
|---|---|---|---|---|---|
| 1,317,016 | A * | 9/1919 | Frueh | A63H 3/08 | 446/388 |
| 1,547,967 | A * | 7/1925 | Shilhan | A63H 3/08 | 273/153 R |
| 2,170,953 | A * | 8/1939 | Spots | A63H 3/08 | 229/116.3 |
| 2,395,118 | A * | 2/1946 | Havel | A63H 3/08 | 446/388 |
| 2,395,247 | A * | 2/1946 | Buffenbarger | A63H 3/08 | 43/3 |
| 4,000,579 | A * | 1/1977 | Gomall | A63H 5/00 | 446/297 |
| 4,239,825 | A * | 12/1980 | Kaulfuss | A63H 33/16 | 40/539 |
| 5,225,255 | A * | 7/1993 | Kaulfuss | A63H 33/16 | 428/16 |
| 6,136,400 | A * | 10/2000 | Katayose | A63H 3/08 | 428/40.1 |
| 2008/0078832 | A1 * | 4/2008 | Halbur | A63H 3/08 | 235/380 |

FOREIGN PATENT DOCUMENTS

| | | | | |
|---|---|---|---|---|
| WO | WO-9426371 A1 * | 11/1994 | ..... | A63H 3/08 |

* cited by examiner

*Primary Examiner* — Eugene L Kim
*Assistant Examiner* — Alyssa M Hylinski

(57) ABSTRACT

The three-dimensional paper bird toy is a simple cut, bend, twist, and paste assembly technique of integrating two field planes found from the same one piece of flat, foldable paper like recyclable "green" material. It can be used as a toy for children as well as an advertising aid for promotions.
The toy bird shape is first a flat symmetrical die cut shape that is either indicated by a line which is where it should be punched or cut out. It is capable of being folded and pasted into a scalable three-dimensional toy or package display. The paper bird toy causes amusement & awareness and creates fun for involved users. The differences with this present invention is it's "green" toy value, meaning it is made from renewable resources, and it's symmetrical die cut design that creates a very dynamic and sturdy shape that has simple and understandable assembly instructions.

3 Claims, 3 Drawing Sheets

INTERACTIVE PAPER BIRD TOY AND FOLDING METHOD

TECHNICAL FIELD

This invention relates to the simple fold and paste system of creating three-dimensional toys and display type characters and scenery. It relates to all skill levels and age groups, making it possible for even more people to enjoy creating paper toy creatures and imaginary worlds by using a standard cut-out template as well as a fold and paste method. The paper bird is made out of recyclable paper that is very abundant and eco-friendly. This present invention's cycle of life as a toy product is "green" meaning it will not sit around after use in a landfill, but will be composted and bio-degraded easily.

BACKGROUND

This present invention can involve it's symmetrical die cut design to be laid out as a pre-punched plate with a die-cut knife board, that perforates or cuts the edges so that a user can punch out the bird toy from a single flat paper sheet themselves and assemble.

Other additional die cutting options of present invention include cutting the symmetrical die cut toy shapes out completely at a professional printer, liberating the toy shape from the flat printing sheet before it reaches it's intended audience. The paper bird toys are shipped and delivered to intended audience in a already assembled state including blank units. Bird units can include pre-printed customized messages or blank units with instructions on how to decorate the paper bird toys with supplies provided in the purchased package such as pens, glitter, feathers, and stickers.

This paper bird toy is made from renewable resources such as recycled paper or other composted products depending on the region of construction. The overall effect is the paper birds being produced locally out of local compost materials, which supports the "green" value of this present toy invention.

Technical Problem

Individuals who were unable to produce dynamic and impressive paper origami shapes due to complexity, can now learn to produce and duplicate the folding method in a simple and understandable way. This paper folding method can generate an array of three-dimensional bird toys and illustrated shapes. Toy patents of previous origin have not been capable of delivering such dynamic play time for children with unlimited options while at the same time being non-expensive and low cost to produce.

Solution to Problem

Unlike plastic toys, this paper toy invention can be easily produced and has a "green" toy value meaning it will not sit in a landfill and will bio-degrade in a short time. This constructed paper toy invention is sturdy enough to function over a long period of time, or can be used and disposed of quickly, either way the toy will bio-degrade and leave almost no carbon footprint.

Advantageous Effects of Invention

For a toy product to sustain long running engagement, it must combine personal energy with mass cross marketing appeal which includes gaming applications on phone devices as well as internet, movies and animations, and printed materials such as books, cards and the like. This present invention involves many types of users across all these markets which makes it special in the way it combines origami toy making with virtual platforms like mentioned above.

BRIEF DESCRIPTION OF THE DRAWINGS

For a fuller understanding of the best forms of this invention, reference should be had to the following detailed description taken in connection with the accompanying drawings in which.

DESCRIPTION OF EMBODIMENTS

Figure 1:
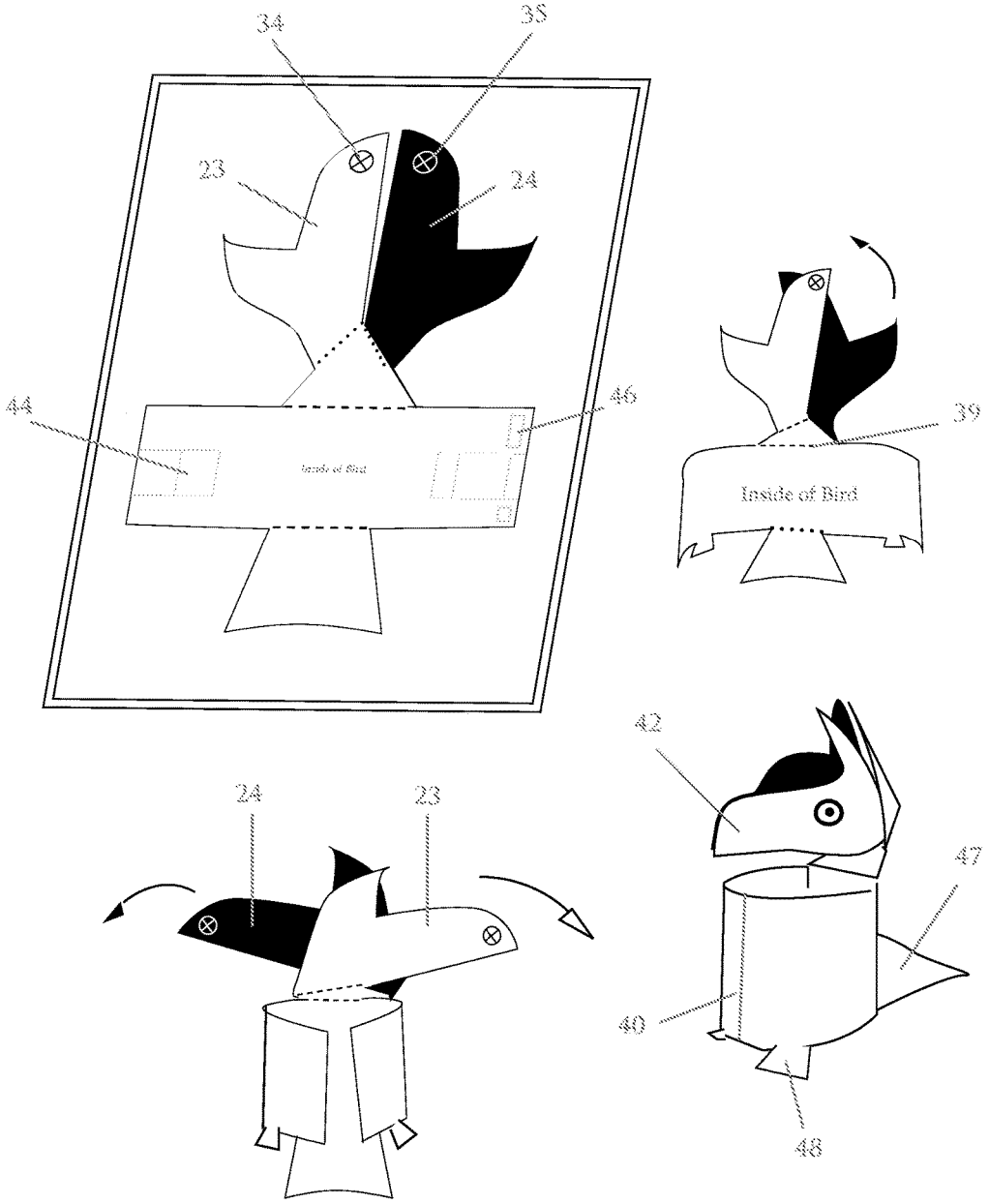
FIG. 1 is a perspective view of one three-dimensional bird toy, image generating member pre-cut and supportingly maintained on a suitable carrier.

The paper bird toy character is retained on carrier sheets, preferably formed as an 8.5 in.×11 in. sheet for ease of transport through conventional standard printers. However other sheet sizes can be used, highlighting another breakthrough of present invention. By employing the symmetrical standard base die cut, the promotional toy can be scaled to any height or size. The figure can be self balancing in large applications as well as very small nano size applications, making the technology scalable and duplication friendly.

The scaling aspect of present invention is also related to the play time value of the paper bird toy. Larger scaled birds are conceived as the elders of the group, and thus a family structure is created with the birds as a whole. The smaller birds become the legs of the larger to convey partnership and interconnective play for the user. Producing this toy invention is profitable, manageable, and yet creative enough to keep it's appeal throughout the trends of the toy industry.

The head element of the paper bird toy has the ability to bounce up and down thus making clicking or tapping noises. Users can effectly make music with the bird toy, depending on their skill level. No other previous toy invention employs so many options, and dynamic ways of play. From assembly time to play time, the present paper bird toy invention playtime features are new and different from existing paper toy inventions—because of all the musical and interconnected qualities that the toy produces for the user.

Eco-friendly "green" toys made in such little time and effort is the main strength of present invention. By using locally sourced renewable materials and low skilled labor, this paper bird toy can reach a wide variety of audiences from across the globe. This positive aspect of creating "green" toys for families is not just a trend happening now, but will continue to be the focus for future families with children.

Importing the symmetrical die cut design, A individual can successfully produce their own toy with their own printer, paper, glue and other decorating materials. In order to provide ease of assembly, the three-dimensional bird character toy preferably incorporates adhesive means, tabs, slots, etc. to enable the image forming member to be quickly and effortlessly fully assembled. Once assembled by the individual user, they can distribute to friends or family members, and the interaction is unique and the base of many conversations. The assembled bird can sit on someone's desk and cause interest, or it can be taken home to the kids to be used and destroyed. The easy to make system of creating these birds toys means it's o.k. destroy, the user can make more!

In the future, this present invention will be featured in animations, games for phone applications and movies featuring the paper bird toy. The focus of paper toy promotes environmental friendly anti-plastic playtime, and family communication through play. Persons of all ages and skill levels will use this bend, twist and paste system to create, tell and communicate the special stories that are unique to them. An individual's intentions can be displayed in a fun, creative, and engaging manner through this present invention.

DETAILED DESCRIPTION

Figure 2:
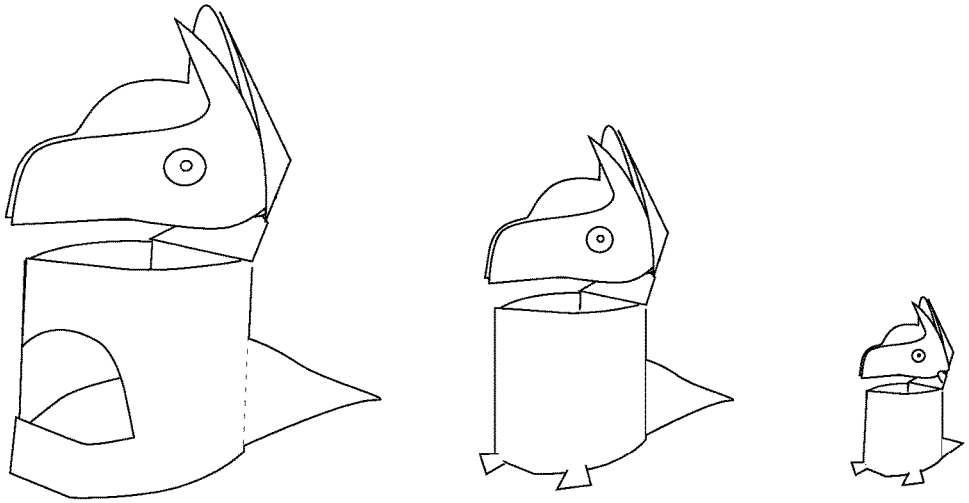
FIG. 2 is a perspective view of a multiple bird designs, scaled accordingly to create the desired effect of the smaller birds becoming the legs for the larger birds. These different sized bird shapes are fitted accordingly on a 8.5×11 sheet.
Figure 2:
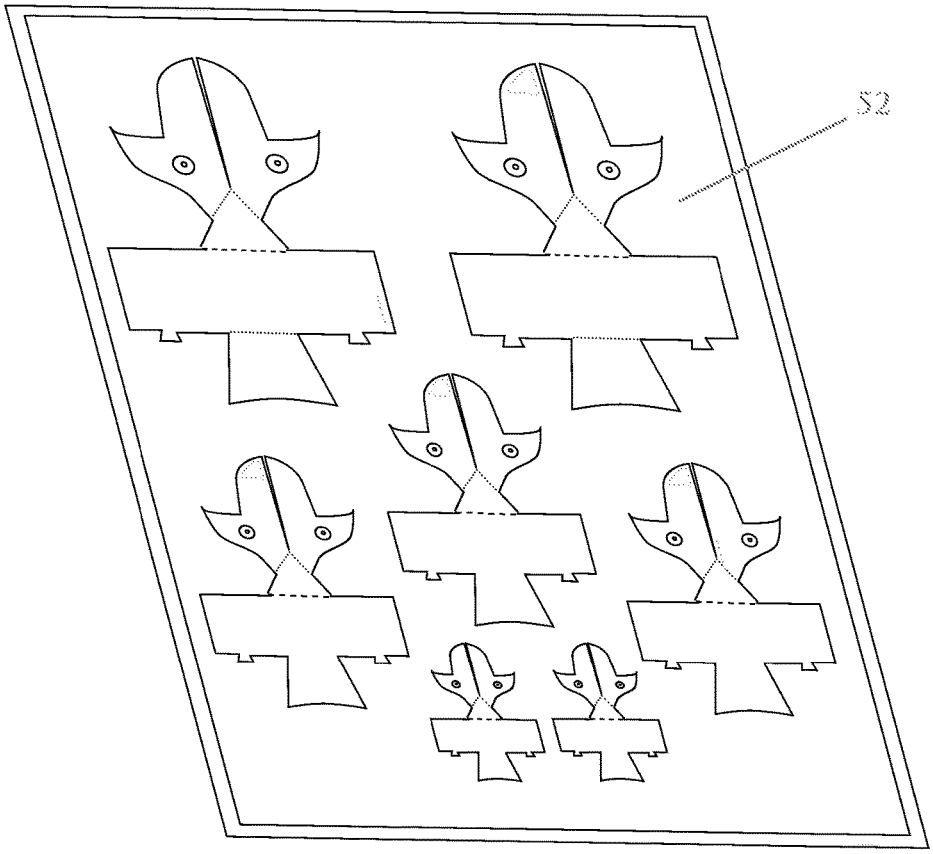
Figure 3:
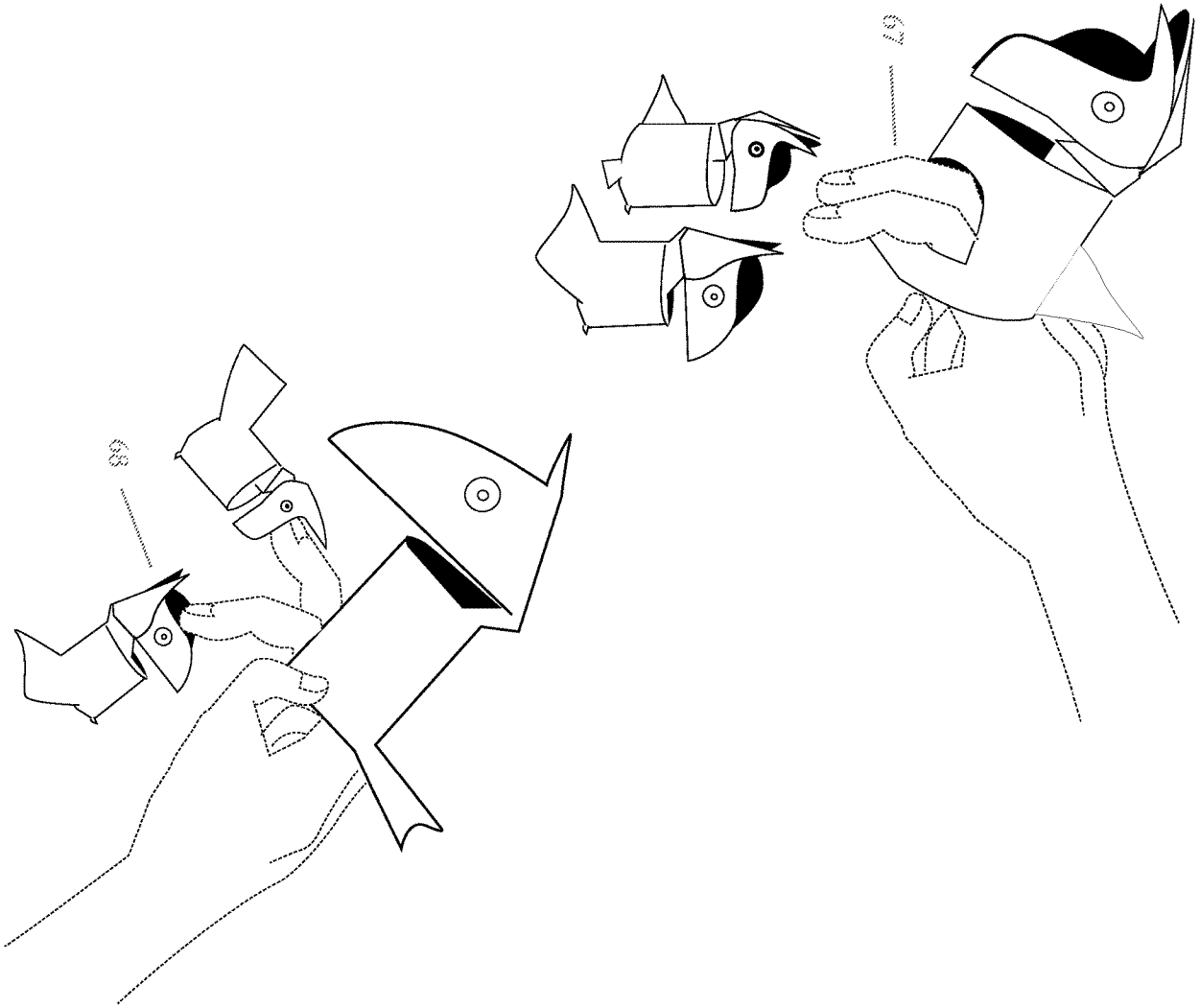
FIG. 3 is a view of the fingers going up through the bottom of the larger bird and out the front panel of the larger toy, which has been cut according to size of users fingers. It also shows how the tips of the fingers enter into the top of the heads of the smaller birds. When fingers move back and forth, it creates the effect of legs walking motion.

By referring to FIGS. 1-3, along with the following detailed disclosure, the overall construction and operation of the present invention can be best comprehended. However, it is to be understood that the embodiments depicted in FIGS. 1-3 are presented for exemplary purposes only, and are not intended as a limitation of the present invention to these particular embodiments. As is evident from this disclosure, any obvious improvements to the best form of this paper bird toy invention can be employed with numerous alternate constructions, all of which are within the scope of the best form of present invention.

The triangular axis simple fold system 39 and center body cylinder shape 40 can incorporate a message zone on the front and inside surfaces of the paper toy. These message zones can be printed upon the bird die cut design through an individual's personal computer design program and printer, or at a professional printing facility. Message zones can also include die cut designs to add visual effects to the paper toy or display.

Panel number 23 and 24 are securely affixed to each other in one location point 42. In the FIG. 2 embodiments depicted, printed die cut template 52 comprises of the printed outside of the sheet depicting the eyes, beak, and other graphic elements depicting a bird. Both inside and outside panels are integrally interpreted as the two sides of a single piece of flat paper.

By utilizing the finger hole cut 67, sticking two fingers through and into the top openings of the smaller separately cut bird characters 68, a visual effect of the smaller character becoming the legs or supports of the larger character is realized. This smaller walking bird motion creates excitement and is a new element that has not been utilized in previous paper toy design and fold methods. This present invention communicates family oriented multi-messages and produces longer periods of high value play time.

The design methodology of present invention is that the tail element, bottom or behind surface 47 represented on the bird toy character FIG. 1, acts like the foot on a leg for the larger completed state toy character. The foot element is shaped like a flipper, but it can be shaped in any manner, either being human or animal, insect, or any other interpreted creative creature, the foot element in the symmetrical die cut template is mathematically positioned to act as a counter-balance for the entire member toy creature making it self standing.

Another feature embodiment of the best form is the ability to custom size the cylinder shape of the toy 40, and paste according to the size of the users finger. Birds can be displayed as overweight or skinny, tall or short, by altering the cylinder shape 40 by means of cutting. The possibilities are endless in this area of the toy shape, this present invention includes all obvious improvements to area 40 that would alter the shape and size of the paper toy bird.

CITATION LIST

U.S. Pat. No. 6,311,142 B1 Glassner; 10/2001
U.S. Pat. No. 8,545,286 B2 Coleman; 10/2013
U.S. Pat. No. 3,505,759 A Mckee; 4/1970

FIELD OF U.S. CLASSIFICATION SEARCH

446/71, 77, 79, 80;
446/82, 83;
446/85, 87, 102, 108;
446/147, 149, 151;
446/268, 327, 387, 388;
434/81, 82, 96;
229/103, 40, 300, 100, 116.1, 116.3, 116.1, 922;

Having described my invention, what I claim as new and desire to secure by Letters Patent is:

1. A folding method for forming a toy bird character comprising the steps of:

a. providing a carrier sheet with a toy bird character design, wherein the toy character design includes:

i) a body panel having a first end and a second opposite end, ii) a triangular neck panel coupled to the body panel about a first fold indicating line, and iii) a head element having a first head panel coupled to the neck panel about a second fold indicating line and a second head panel coupled to the neck panel about a third fold indicating line, wherein each head panel includes a proximal top feather portion and a distal beak portion;

b. separating the toy character design from the carrier sheet;

c: folding the toy character design to form the toy bird character by bending the neck panel rearwardly relative to the body panel about the first fold indicating line, bending the first and second head panels about the second and third fold indicating lines, respectively, such that the panels cross each other at the proximal top feather portions and then bringing the distal beak portions into alignment and affixing them together to form a movable head of the toy bird character and bending the body panel forwardly relative to the bending of the neck panel and affixing the first and second ends to define a body of the toy bird character, and d. providing an aperture in the body configured to receive fingers of a user.

2. The folding method of claim 1 further comprising the step of applying a bouncing motion to the toy bird character such that the movable head produces a clicking or tapping noise.

3. The folding method of claim 1 further comprising the step of creating a walking effect for the toy bird character when the user's fingers are received in the aperture.

* * * * *